US011414854B2

(12) United States Patent
Jewell

(10) Patent No.: US 11,414,854 B2
(45) Date of Patent: Aug. 16, 2022

(54) PORTABLE TRAINING STUDIO

(71) Applicant: Let's Dryft, Inc., San Mateo, CA (US)

(72) Inventor: Nathaniel Jewell, San Mateo, CA (US)

(73) Assignee: Let's Dryft, Inc., San Mateo, CA (US)

( * ) Notice: Subject to any disclaimer, the term of this patent is extended or adjusted under 35 U.S.C. 154(b) by 0 days.

(21) Appl. No.: 17/023,897

(22) Filed: Sep. 17, 2020

(65) Prior Publication Data

US 2021/0079644 A1 Mar. 18, 2021

Related U.S. Application Data

(60) Provisional application No. 62/902,105, filed on Sep. 18, 2019.

(51) Int. Cl.

| | |
|---|---|
| ***E04B 1/344*** | (2006.01) |
| ***E04H 3/14*** | (2006.01) |
| ***E04B 1/343*** | (2006.01) |

(52) U.S. Cl.

CPC ..... *E04B 1/3445* (2013.01); *E04B 1/34336* (2013.01); *E04H 3/14* (2013.01)

(58) Field of Classification Search

CPC . E04B 1/34384; E04B 1/3445; E04B 1/34336
See application file for complete search history.

(56) References Cited

U.S. PATENT DOCUMENTS

| | | | | |
|---|---|---|---|---|
| 3,181,203 | A * | 5/1965 | Wenger | E04H 3/12 52/6 |
| 5,170,901 | A | 12/1992 | Bersani | |
| RE34,468 | E * | 12/1993 | Rau | E04H 3/24 296/26.02 |
| 5,345,730 | A * | 9/1994 | Jurgensen | E04B 1/3444 52/64 |
| 5,667,267 | A * | 9/1997 | Talucci | B60P 3/14 296/26.15 |
| 5,966,956 | A * | 10/1999 | Morris | F25D 11/003 52/69 |
| 8,720,125 | B2 | 5/2014 | Andretich | |
| 10,047,514 | B2 | 8/2018 | Sparks et al. | |
| 10,398,937 | B2 * | 9/2019 | Beaver | A63B 5/16 |
| 10,967,224 | B2 * | 4/2021 | Beaver | A63B 71/02 |

(Continued)

FOREIGN PATENT DOCUMENTS

| | | | |
|---|---|---|---|
| GB | 2097341 | A | 11/1982 |

OTHER PUBLICATIONS

MoveStudios, Studio, MOVE With Us Newsletter, dated Oct. 28, 2020. <https://www.movestudios.net/post/movestudios-is-on-the-move>.

(Continued)

*Primary Examiner* — Babajide A Demuren

(74) *Attorney, Agent, or Firm* — Young Basile Hanlon & MacFarlane, P.C.

(57) ABSTRACT

A portable training studio is disclosed. The portable training studio includes an expandable structure that is reconfigurable between a transport configuration and a use configuration. The expandable structure includes: a frame; a first door that is pivotably connected to the frame such that the first door is movable between an open position and a closed position; and a first deck that is pivotably connected to the frame such that the first deck is movable between an open position and a closed position.

20 Claims, 7 Drawing Sheets

(56) References Cited

U.S. PATENT DOCUMENTS

2009/0013614 A1* 1/2009 Rogers ..... B60P 3/34 52/66
2009/0272046 A1* 11/2009 Letscher, III ..... E04B 1/34336 52/79.6
2010/0024314 A1* 2/2010 Pope ..... E04B 1/3431 52/67
2010/0043308 A1* 2/2010 Keeble ..... E04B 1/34321 52/79.1
2010/0269419 A1* 10/2010 Gyory ..... E04B 1/3444 52/79.5
2012/0006369 A1* 1/2012 Cantin ..... E04B 1/3444 135/96
2012/0151851 A1 6/2012 Cantin et al.
2015/0059257 A1* 3/2015 Beaver ..... E04H 3/10 52/27
2015/0218794 A1* 8/2015 Martyn ..... E04B 1/3444 52/79.5
2015/0292194 A1* 10/2015 Calafatis ..... E04B 1/34384 52/67
2016/0059104 A1* 3/2016 Monaco ..... E04H 3/14 280/30
2016/0059105 A1* 3/2016 Scade Garcia ..... E04H 1/12 52/69
2016/0102740 A1* 4/2016 Martyn ..... E04B 1/3444 52/69
2017/0296876 A1* 10/2017 Beaver ..... A63B 21/04
2017/0350114 A1* 12/2017 Crozier ..... E04B 1/34336
2018/0186272 A1 7/2018 Borden

OTHER PUBLICATIONS

MoveStudios, Studio, MOVE With Us Newsletter, dated Oct. 28, 2020. <https://www.movestudios.net/blank-page-1>.

* cited by examiner

PORTABLE TRAINING STUDIO

CROSS-REFERENCE TO RELATED APPLICATION(S)

This application claims priority to and the benefit of U.S. Provisional Patent Application No. 62/902,105, filed Sep. 18, 2019, the entire disclosure of which is hereby incorporated by reference.

TECHNICAL FIELD

The present disclosure relates generally to training studios and, more specifically, to portable gyms.

BACKGROUND

Portable training studios (e.g., gyms) are generally accessible and widely available to the community. While there have been advancements in recent years relating to the format, style, and culture of conventional training studios, gyms are still, in large part, brick and mortar facilities. A need thus remains for a training studio that offers the benefits of a traditional setting while adding the convenience and flexibility associated with portability.

SUMMARY

In one aspect of the present disclosure, a portable training studio is disclosed. The portable training studio includes an expandable structure that is reconfigurable between a transport configuration and a use configuration. The expandable structure includes: a frame; a first door that is pivotably connected to the frame such that the first door is movable between an open position and a closed position; and a first deck that is pivotably connected to the frame such that the first deck is movable between an open configuration and a closed configuration.

In certain embodiments, the frame may include: a roof; a base that supports the roof; and end walls that extend between the roof and the base.

In certain embodiments, the frame may further include a side wall that is positioned opposite to the first door such that the side wall extends between the roof and the base.

In certain embodiments, the end walls and the side wall may each be fixed in relation to the base.

In certain embodiments, the first deck may be pivotably connected to the frame such that the first deck is positioned inwardly of the first door when the expandable structure is in the transport configuration.

In certain embodiments, the first door may be reconfigurable between a collapsed configuration and an expanded configuration.

In certain embodiments, the first door may include a first panel and a second panel that is slidably connected to the first panel such that the second panel is movable in relation to the first panel during reconfiguration of the first door between the collapsed configuration and the expanded configuration.

In certain embodiments, the second panel may be telescopically connected to the first panel such that the second panel is movable along an axis that extends in generally orthogonal relation to a longitudinal axis of the door.

In certain embodiments, the frame may further include a second door that is positioned opposite to the first door and a second deck that is positioned opposite to the first deck.

In certain embodiments, the second door may be pivotably connected to the frame such that the second door is movable between an open position and a closed position.

In certain embodiments, the second deck may be pivotably connected to the frame such that the second deck is movable between an open configuration and a closed configuration.

In certain embodiments, the second door may be generally identical to the first door.

In certain embodiments, the second deck may be generally identical to the first deck.

In another aspect of the present disclosure, a portable training studio is disclosed. The portable training studio includes an expandable structure that is reconfigurable between a transport configuration and a use configuration. The expandable structure includes a frame and a door that is pivotably connected to the frame such that the door is movable between an open position and a closed position. The door defines a longitudinal axis and includes: a first panel; a second panel that is movably connected to the first panel such that the door is reconfigurable between a collapsed configuration and an expanded configuration; and a tensioning mechanism that is connected to the door. The tensioning mechanism extends along the longitudinal axis of the door to inhibit deflection of the door in the expanded configuration.

In certain embodiments, the tensioning mechanism may include a support having a first end connected to a first end region of the door and a second end connected to a second end region of the door.

In certain embodiments, the support may apply a force to the door that is directed outwardly away from a centerline of the door.

In certain embodiments, the expandable structure may further include a drive mechanism that is connected to the door to move the door between the open position and the closed position.

In certain embodiments, the drive mechanism may include an extender that extends between the frame and a first end region of the door.

In certain embodiments, the extender may be slidably connected to the door.

In another aspect of the present disclosure, a method for operating a portable training studio is disclosed that includes reconfiguring an expandable structure from a transport configuration to a use configuration by moving a door that is pivotably connected to a frame of the expandable structure from a closed position to an open position and by moving a deck that is pivotably connected to the frame from a closed configuration to an open configuration.

In certain embodiments, the method may further include moving the door from a collapsed configuration to an expanded configuration.

In certain embodiments, moving the door from the collapsed configuration to the expanded configuration may include telescopically moving a first section of the door in relation to a second section of the door.

BRIEF DESCRIPTION OF THE DRAWINGS

The present disclosure is best understood from the following detailed description when read in conjunction with the accompanying drawings. It is emphasized that, according to common practice, the various features of the drawings may not be to scale. On the contrary, the dimensions of the various features may be arbitrarily expanded or reduced for clarity.

DETAILED DESCRIPTION

Figure 1:
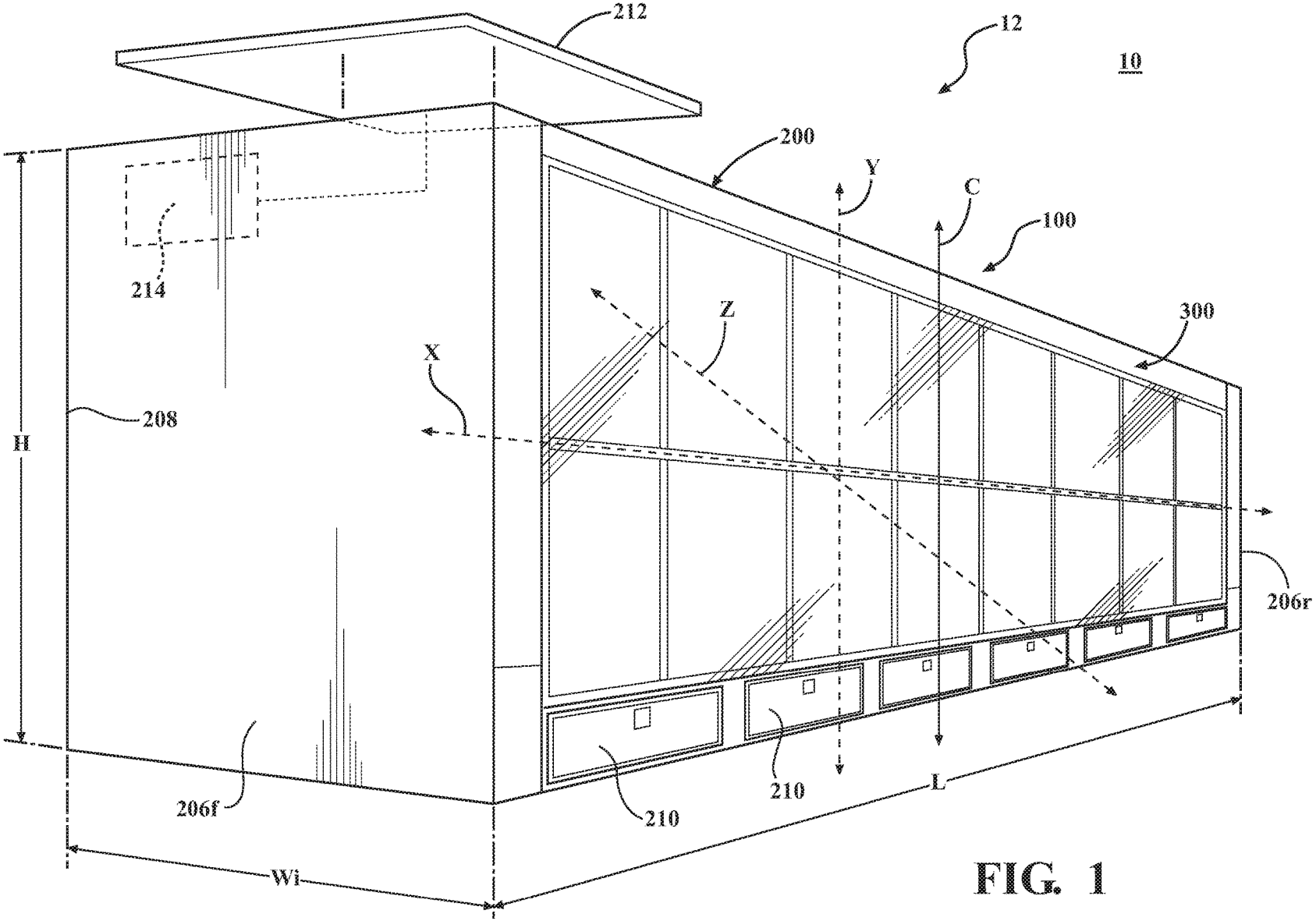
FIG. 1 is an end, perspective view of a portable training studio in accordance with the principles of the present disclosure shown in a transport configuration.

The present disclosure relates to portable training studios (e.g., gyms) and associated methods of use and operation. The portable training studio described herein includes an expandable structure that is reconfigurable between a transport configuration (e.g., during movement of the training studio between locations) and a use configuration. The expandable structure includes: a frame; a reconfigurable door; and a reconfigurable deck. The door is pivotably connected to the frame so as to allow for movement between an open position and a closed position and the deck is pivotably connected to the frame so as to allow for movement between an open configuration and a closed configuration.

In addition to being movable between the open and closed positions, the door is reconfigurable between collapsed and expanded configurations via sliding (e.g., telescopic) movement of one panel of the door in relation to another, which increases the footprint and the effective training area of the portable training studio to accommodate an increased number of users. To inhibit (if not entirely prevent) deflection of the door in the expanded configuration, in certain embodiments, the door may include a tensioning mechanism that is configured to apply an outwardly-directed force (e.g., a force that is directed away from a centerline of the door and towards opposite (front and rear) end regions of the door). For example, the tensioning mechanism may include a cable that is connected to the opposite end regions of the door and a tensioner (e.g., a winch, a ratchet mechanism, etc.) that is connected to the cable so as to pull the opposite end regions of the door away from each other to thereby inhibit (if not entirely prevent) sagging in the door.

Referring now to the drawings, FIGS. 1-7 illustrate a portable training studio 10 (e.g., a gym 12) according to the principles of the present disclosure. In various embodiments, it is envisioned that the studio 10 may itself be configured as a vehicle or, alternatively, that the studio 10 may be configured for connection to a vehicle (e.g., to a truck, a trailer, etc.).

The studio 10 includes an expandable structure 100 defining an axial length L (FIG. 1) that is measured along a first (longitudinal) axis X; a width W that is measured along a second axis Y that is transverse (e.g., orthogonal) in relation to the first axis X; and a height H that is measured along a third axis Z that is transverse (e.g., orthogonal) in relation to the first axis X and the second axis Y. As discussed in further detail below, the studio 10 is reconfigurable between a transport (first, initial) configuration (FIG. 1), in which the expandable structure 100 defines a width Wi, and a use (second, subsequent) configuration (FIG. 6), in which the expandable structure 100 defines a width Wii. For example, it is envisioned that, in the transport configuration, the width Wi may lie substantially within the range of (approximately) 6 feet to (approximately) 10 feet, and that in the use configuration, the width Wii may lie substantially within the range of (approximately) 24 feet to (approximately) 30 feet. It should be appreciated, however, that widths Wi, Wii outside these ranges would not be beyond the scope of the present disclosure (e.g., depending upon the intended occupancy of the studio 10).

The expandable structure 100 includes a frame 200 as well as a (first) door 300 and a (first) deck 400 (FIG. 2), each which is pivotable in relation to the frame 200. It is envisioned that the expandable structure 100 (and the components thereof) may include any suitable material or combination of materials. For example, it is envisioned that the frame 200, the door 300, and the deck 400 may include (e.g., may be formed partially or entirely from) one or more metallic materials (e.g., steel, aluminum, titanium, etc.) and/or one or more non-metallic materials (e.g., plastic(s), polymer(s), carbon fiber, 3-D printed material, etc.).

The frame 200 includes: a base (floor) 202 (FIG. 3A); a roof 204 that is supported by the base 202; a pair of end walls 206 (e.g., respective front and rear end walls **206*f*, 206*r* (FIG. 1)); and a side wall 208 that is positioned opposite to the door 300. The end walls 206 and the side wall 208 are supported by (e.g., are fixed in relation to) the base 202 and extend between the base 202 and the roof 204**.

As seen in FIG. 1, in certain embodiments, the frame 200 may be configured so as to include (or otherwise provide) one or more bins 210, which may be configured and/or utilized as lockers, towel stations, equipment drawers, or in any other suitable or desired manner. In the illustrated embodiment, for example, the bin(s) 210 are supported beneath the base 202. It should be appreciated, however, that alternate locations for the bin(s) 210 would not be beyond the scope of the present disclosure. It is also envisioned that the expandable structure 100 (e.g., the frame 200) may incorporate a network of cables, wires, etc., to support the installation of speakers, televisions, a Wi-Fi network, charging stations, etc.

In the particular embodiment of the studio 10 shown throughout the figures, the base 202, the roof 204, the end walls 206, the side wall 208, the door 300, and the deck 400 are configured and arranged such that the expandable structure 100 includes a generally rectangular (transport) configuration. It should be appreciated, however, that the specific configuration of the expandable structure 100 may be altered in various embodiments without departing from the scope of the present disclosure.

In certain embodiments of the present disclosure, it is envisioned that the roof 204 may include one or more solar panels 212 (FIG. 1) to provide power to various systems and components of the studio 10. In such embodiments, the number, size, and location of the solar panel(s) 212 may be customized based upon the power requirements of the studio 10. It is further envisioned that the power generated by the solar panel(s) 212 may be stored in one or more batteries 214 (or other such suitable storage units).

The door 300 is pivotably connected to the frame 200 (opposite to the side wall 208 (FIGS. 1, 3A)) at one or more (upper) pivot locations Pu (FIGS. 2, 4), which allows for movement of the door 300 between a closed position (FIGS. 1, 3A), in which the door 300 extends (generally) vertically in (generally) parallel relation to the height H of the expandable structure 100 (and the axis Y), and an open position (FIGS. 2, 4), in which the door 300 extends (generally) horizontally in (generally) parallel relation to the width W of the expandable structure 100 (and the axis Z). To facilitate movement of the door 300 between the closed position and the open position, the expandable structure 100 includes a drive mechanism 302 (FIG. 2) that extends between the frame 200 and the door 300. More specifically, in the illustrated embodiment, the drive mechanism 302 includes a (first) extender 304*i* that is located adjacent (connected) to a (front, first) end region 306*f* of the door 300 and a (second) extender 304*ii* that is located adjacent (connected) to a (rear, second) end region 306*r* of the door 300, each of which is illustrated as a shock absorber 308 (pneumatic, hydraulic, etc.). It should be appreciated, however, that the particular number, location, and/or configuration of the extender(s) 304 may be varied in alternate embodiments without departing from the scope of the present disclosure (e.g., depending upon the specific weight of the door 300).

Figure 2:
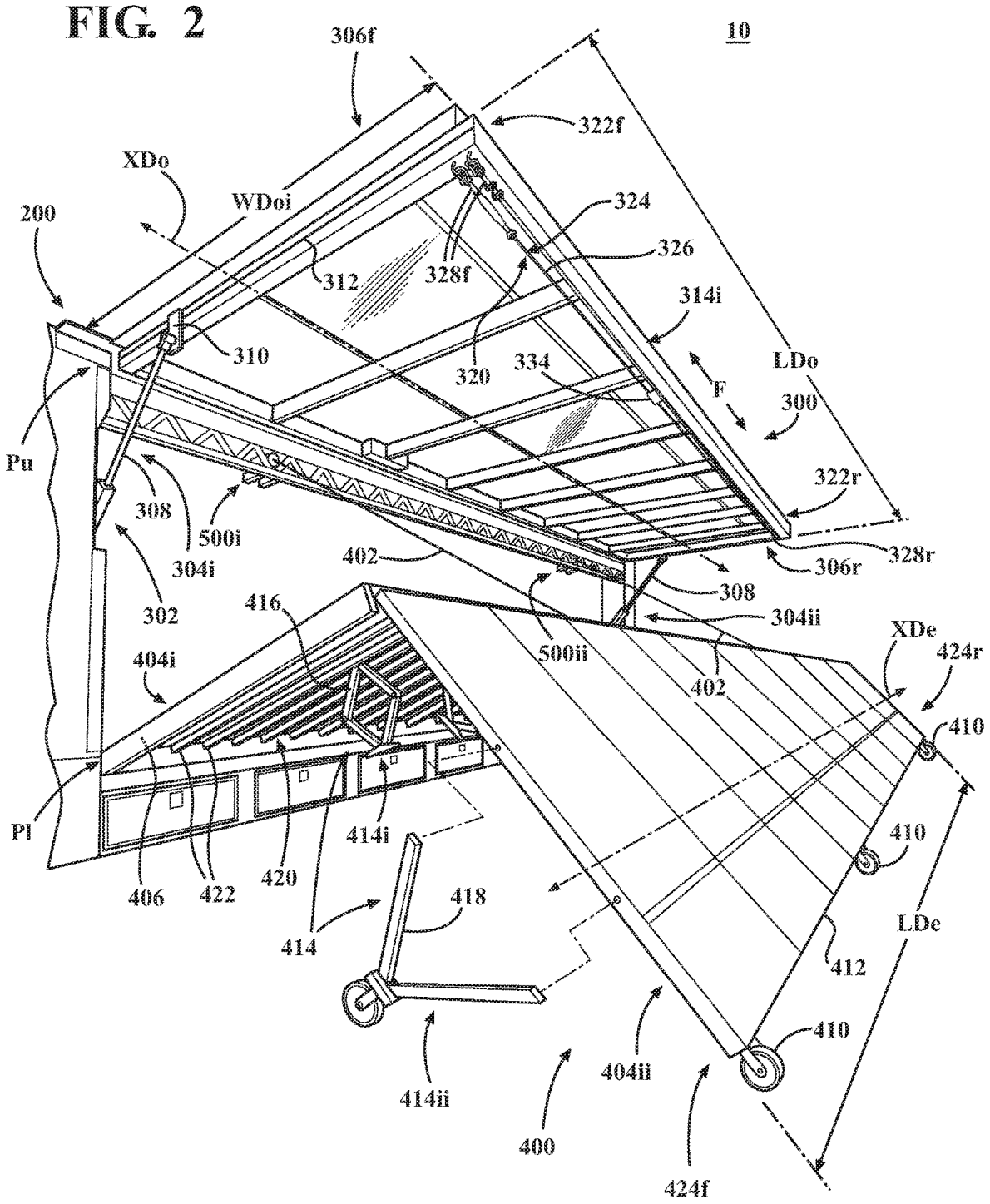
FIG. 2 is an end, perspective view of the portable training studio during movement from the transport configuration into a use configuration.
Figure 3B:
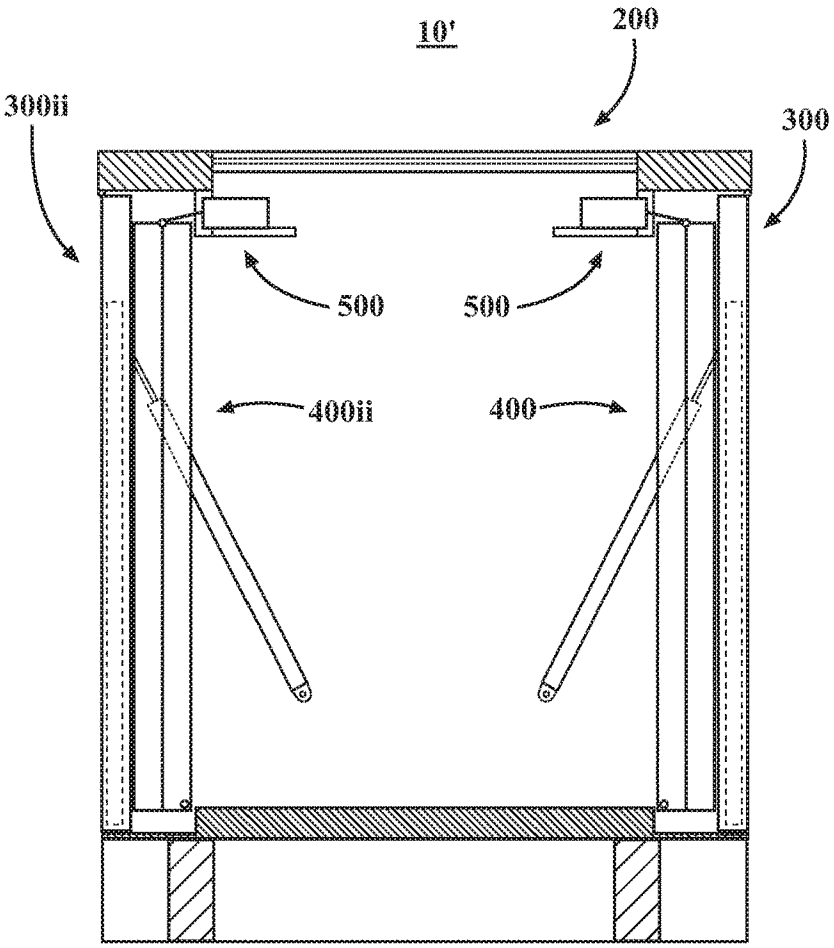
FIG. 3B is an end, cross-sectional view of an alternate embodiment of the portable training studio shown in the transport configuration.
Figure 3A:
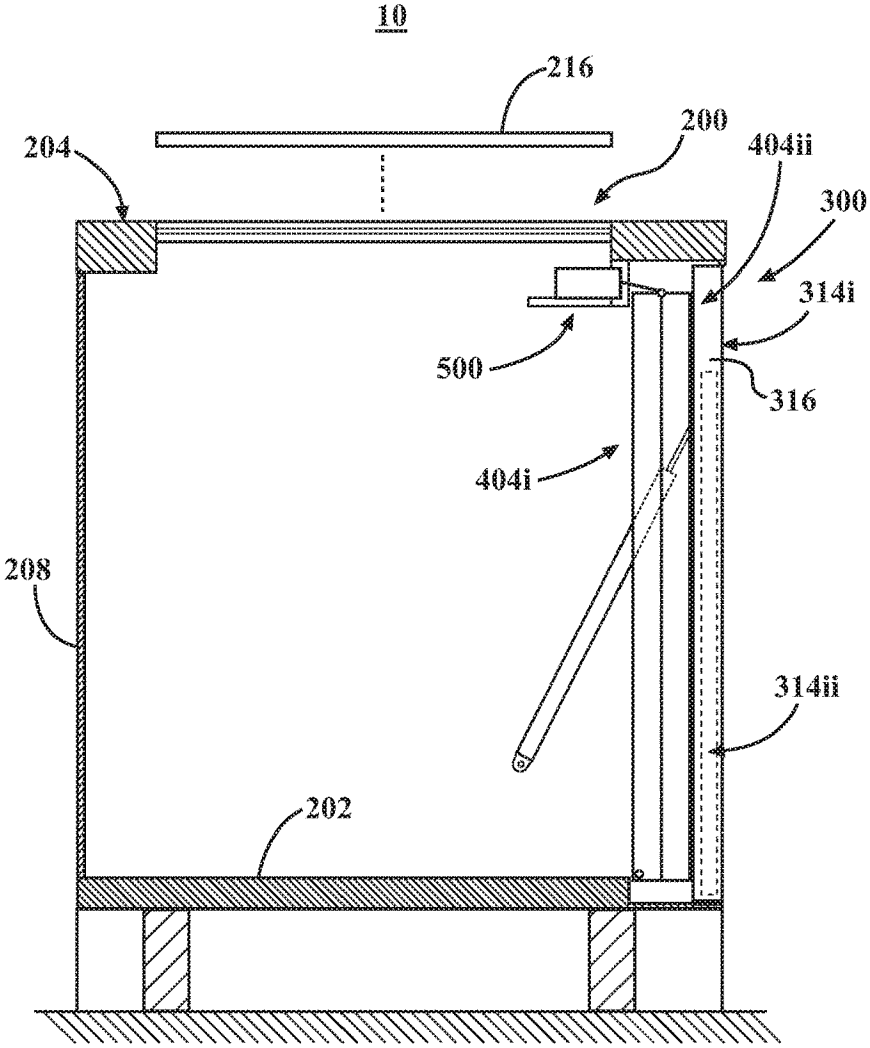
FIG. 3A is an end, cross-sectional view of the portable training studio shown in the transport configuration.
Figure 4:
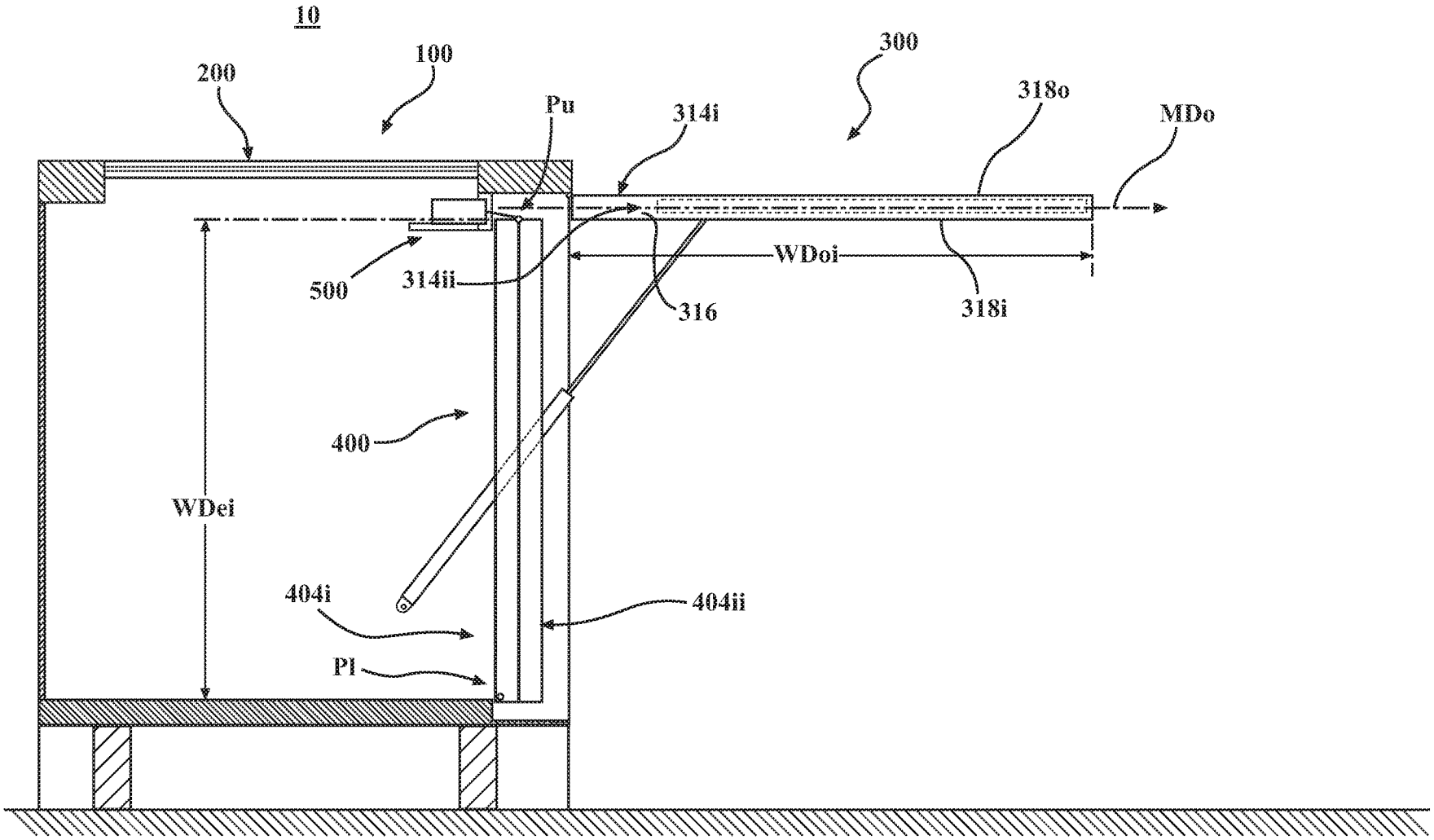
FIG. 4 is an end, cross-sectional view of the portable training studio with a door of the portable training studio shown in an open position and in a collapsed configuration and with a deck of the portable training studio shown in a closed configuration.
Figure 5:
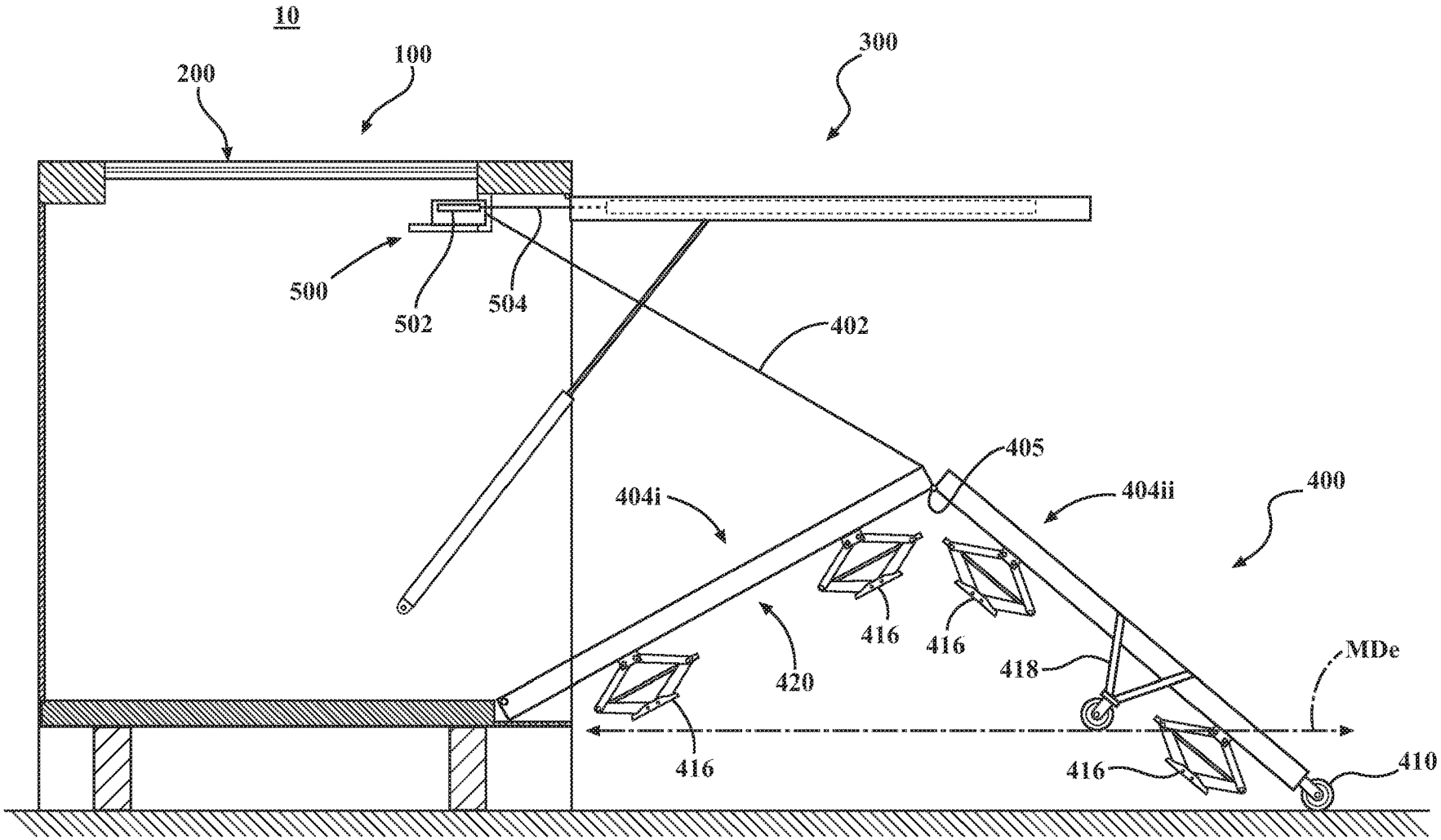
FIG. 5 is an end, cross-sectional view of the portable training studio with the door shown in the open position and in the collapsed configuration and with the deck shown during movement from the closed configuration to an open configuration.

In certain embodiments, such as that seen in FIG. 2, it is envisioned that the extender(s) 304 may include a foot 310 that is movable (e.g., slidable) in relation to the door 300. For example, the door 300 may include (define) a channel 312 (e.g., a recess, an opening, etc.) that is configured to receive the foot 310 such that the foot 310 is movable through the channel 312 in (generally) parallel relation to the axis Y as the door 300 moves between the closed position and the open position.

The door 300 includes a (first) door panel (section) 314*i* and a (second) door panel (section) 314*ii* that is movable in relation to the (first) door panel 314*i*. In the illustrated embodiment, for example, the door panels 314*i*, 314*ii* are connected to each other in a telescopic arrangement that allows the door panel 314*ii* to slide in relation to the door panel 314*i*, which facilitates reconfiguration of the door 300 between a collapsed (first, initial) configuration, in which the door 300 defines a (first) width WDoi (FIG. 4) that (generally) approximates the height H of the expandable structure 100, and an expanded (second, subsequent) configuration, in which the door 300 defines a (second) width WDoii (FIG. 6) that exceeds the height H of the expandable structure 100. More specifically, the door panel 314*ii* is movable in relation to the door panel 314*i* along an axis of movement MDo that extends in (generally) parallel relation to the width WDo of the door 300 and in (generally) orthogonal relation to a length LDo (FIG. 2) of the door 300 (and a (longitudinal) axis XDo thereof).

The height H of the studio 10 is limited by various regulations that are imposed on movable vehicles, which also necessarily limits the width WDoi of the door 300 in the collapsed configuration (e.g., when the studio is being transported). The multi-panel construction of the door 300, however, allows the effective training area A (FIG. 6) (footprint) provided by the studio 10 in the use configuration to be suitably increased. For example, upon movement of the door 300 into the expanded configuration, the width W of the expandable structure 100 may be extended by (approximately) 14 feet to (approximately) 24 feet, as discussed above. It should be appreciated, however, that the dimensions of the door panel 314*i* and/or the door panel 314*ii* may be varied as necessary or desired to further alter the effective training area A provided by the studio 10 in the use configuration.

In the illustrated embodiment, the door panel 314*ii* is slidable into and out of a cavity 316 (FIGS. 3A, 4) defined by the door panel 314*i* such that the door panel 314*ii* is (at least partially) positioned within the door panel 314*i* when the door 300 is in the collapsed configuration. It is envisioned, however, that the door panel 314*ii* may also be located externally of the door panel 314*i*. For example, the door panel 314*ii* may be slidable along an outer surface 318*i* of the door panel 314*i* or along an inner surface 318*i* of the door panel 314*i*. To facilitate movement of the door panel 314*ii* in relation to the door panel 314*i*, it is envisioned that the door panels 314*i*, 314*ii* may include any suitable structure, such as, for example, a rail system, guides, telescoping rods, etc.

As seen in FIG. 2, for example, the expandable structure 100 includes one or more control mechanisms 500 that are supported by the frame 200 and connected to the door 300 so as to facilitate movement of the door 300 between the collapsed configuration and the expanded configuration. Depending upon the particular configuration of the control mechanism(s) 500 and the door panels 314*i*, 314*ii*, it is envisioned that the control mechanism(s) 500 may act upon either or both of the door panels 314*i*, 314*ii*. The control mechanism(s) 500 may include any structures and components suitable for the intended purpose of expanding the door 300 in the manner described herein. For example, it is envisioned that the control mechanism(s) 500 may include a motor 502 (FIG. 5) and an actuator 504 that is driven by the motor 502. In various embodiments, it is envisioned that the actuator 504 may be configured for linear movement (e.g., extension and retraction) such that operation of the motor 502 drives the actuator 504 and, thus, the door panel 314*ii*, laterally outward (e.g., away from the frame 200). Alternatively, it is envisioned that the actuator 504 may include a threaded (screw-type) configuration such that rotation of the actuator 504 by the motor 502 is translated into lateral motion of the door panel 314*ii*.

Although shown as including a pair (e.g., first and second) control mechanism(s) 500*i*, 500*ii* that are spaced axially from each other along the length L of the expandable structure 100 in the particular embodiment of the studio 10 shown throughout the figures, it should be appreciated that the particular number, location, and/or configuration of the control mechanism(s) 500 may be varied without departing from the scope of the present disclosure. For example, depending upon the specific weight of the door 300 (e.g., the door panels 314*i*, 314*ii*), it is envisioned that the studio 10 may include a single control mechanism 500 only.

Figure 7:
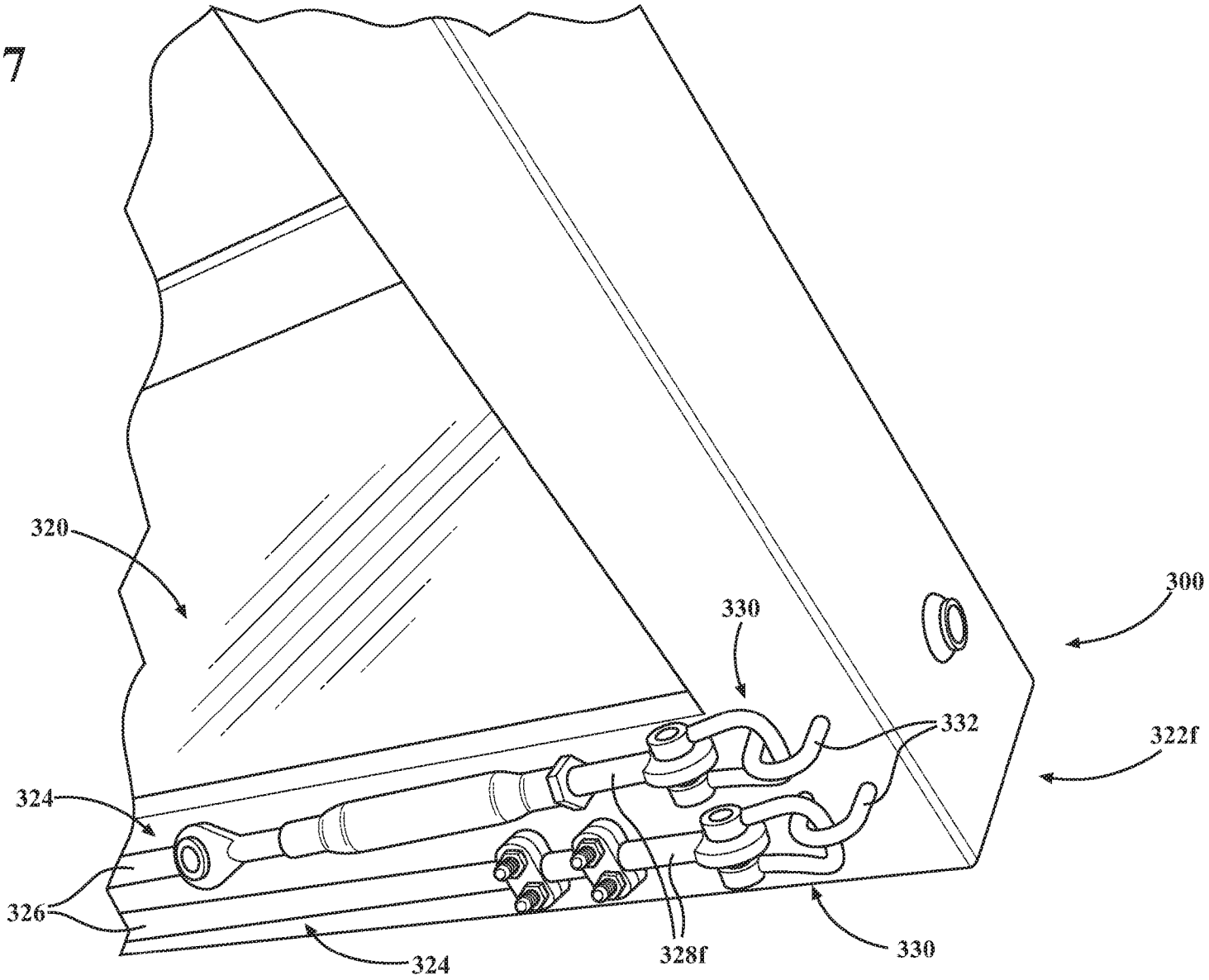
FIG. 7 is a partial, perspective view of the door showing a tensioning mechanism configured to inhibit deflection of the door in the expanded configuration.

To inhibit (if not entirely prevent) deflection of the door 300 in the expanded configuration, in certain embodiments, such as that illustrated throughout the figures, the door 300 includes a tensioning mechanism 320 (FIGS. 2, 7). The tensioning mechanism 320 applies a force F (FIG. 2) to the door 300 that is directed outwardly (e.g., away from a centerline C (FIG. 1) of the door 300) and towards opposing (front and rear) end regions 322*f*, 322*r* thereof along the longitudinal axis XDo. The force F counteracts sagging in the door 300 that may otherwise result from the cantilevered orientation of the door panels 314 when the door 300 is in the open and expanded configurations.

The tensioning mechanism 320 extends along the (longitudinal) axis XDo of the door 300 and includes a support 324. In the illustrated embodiment, the support 324 includes one or more cables 326 with opposing (front and rear) ends 328*f*, 328*r* that are configured for connection to the opposing (front and rear) end regions 322*f*, 322*r* of the door 300 (e.g., the door panel 314*i*), respectively. In alternate embodiments, however, it is envisioned that the configuration of the support 324 may be varied without departing from the scope of the present disclosure. For example, it is envisioned that the support 324 may include one or more (flexible) straps, chain(s), (rigid) rods, etc. The ends 328*f*, 328*r* of the cable(s) 326 include retainers 330 (e.g., hooks, claps, clamps, etc.) that are configured for engagement with (connection to) eyelets 332 that are fixedly connected (e.g., welded) to the door 300.

It is envisioned that the support 324 may be pre-tensioned (e.g., during assembly of door 300) or, alternatively, that the tensioning mechanism 320 may include a tensioner 334 (FIG. 2) that is connected to the support 324 so as to apply and/or vary tension in the support 324 as necessary. In such embodiments, the tensioner 334 may include any structure or mechanism suitable for the intended purpose of applying the aforementioned force F to the door 300 including, for example, a winch, a ratchet mechanism, etc.

To further inhibit (if not entirely prevent) deflection of the door 300, and/or reduce the load on the drive mechanism 302, the studio 10 may also include one or more removable support columns 336 (FIG. 6) that are configured to support the door 300 in the open position. In such embodiments, it is envisioned that the support columns 336 may be configured for connection to the door 300 and/or the deck 400 in any suitable manner such as, for example, via the use of bolts or other such mechanical fasteners.

With continued reference to FIGS. 1-7, the deck 400 will be discussed. In combination with the base 202, the deck 400 provides a platform P (FIG. 6) in the training area A that supports users during use of the studio 10. To improve the user experience, in various embodiments of the present disclosure, it is envisioned that the platform P (e.g., the base 202 and/or the deck 400) may include one or more shock absorbing materials such as, for example, an overlay that includes rubber, foam padding, etc.

The deck 400 is positioned inwardly of the door 300 (e.g., closer to a geometrical center of the expandable structure 100) when the expandable structure 100 is in the transport configuration, which reduces the spatial requirements of the deck 400 and the door 300 and allows for an overall reduction in the width Wi of the expandable structure 100 in the transport configuration. To further reduce spatial requirements, it is envisioned that the door 300 and/or the frame 200 may include a recess, a cavity, a chamber, a cutout, a notch, or the like, that is configured to receive the deck 400 when the expandable structure 100 is in the transport configuration such that the deck 400 nests within the door 300 and/or the frame 200.

The deck 400 is pivotably connected to the frame 200 (opposite to the side wall 208) at one or more (lower) pivot locations Pl (FIGS. 2, 4), which allows for reconfiguration of the deck 400 between a closed (first, initial, collapsed) configuration (FIGS. 3A, 4), in which the deck 400 extends (generally) vertically in (generally) parallel relation to the height H of the expandable structure 100 (and the axis Y), and an open (second, subsequent, expanded) configuration (FIG. 6), in which the deck 400 extends (generally) horizontally in (generally) parallel relation to the width W of the expandable structure 100 (and the axis Z). To facilitate movement of the deck 400 between the closed position and the open configuration, the deck 400 may be (removably) connectable to the control mechanism(s) 500 discussed above in connection with the door 300 via one or more leads 402 (FIG. 2) (e.g., cables, wires, chain, straps, etc.). Alternatively, it is envisioned that the studio may include one or more (first) control mechanism(s) 500 that are configured for connection to the door 300 and one or more discrete (second) control mechanism(s) 500 that are configured for connection to the deck 400. Upon deployment (unfolding) of the deck 400 (e.g., when the deck 400 is in the open configuration), it is envisioned that the lead(s) 402 may be disconnected from the deck 400 and retracted (or otherwise stowed) so as not to interfere with use of the studio 10.

As mentioned above, while the studio 10 is shown as including a pair of control mechanism(s) 500*i*, 500*ii* in the particular embodiment of the studio 10 shown throughout the figures, it should be appreciated that the particular number, location, and/or configuration of the control mechanism(s) 500 may be varied without departing from the scope of the present disclosure (e.g., depending upon the specific weight of the deck 400).

Figure 6:
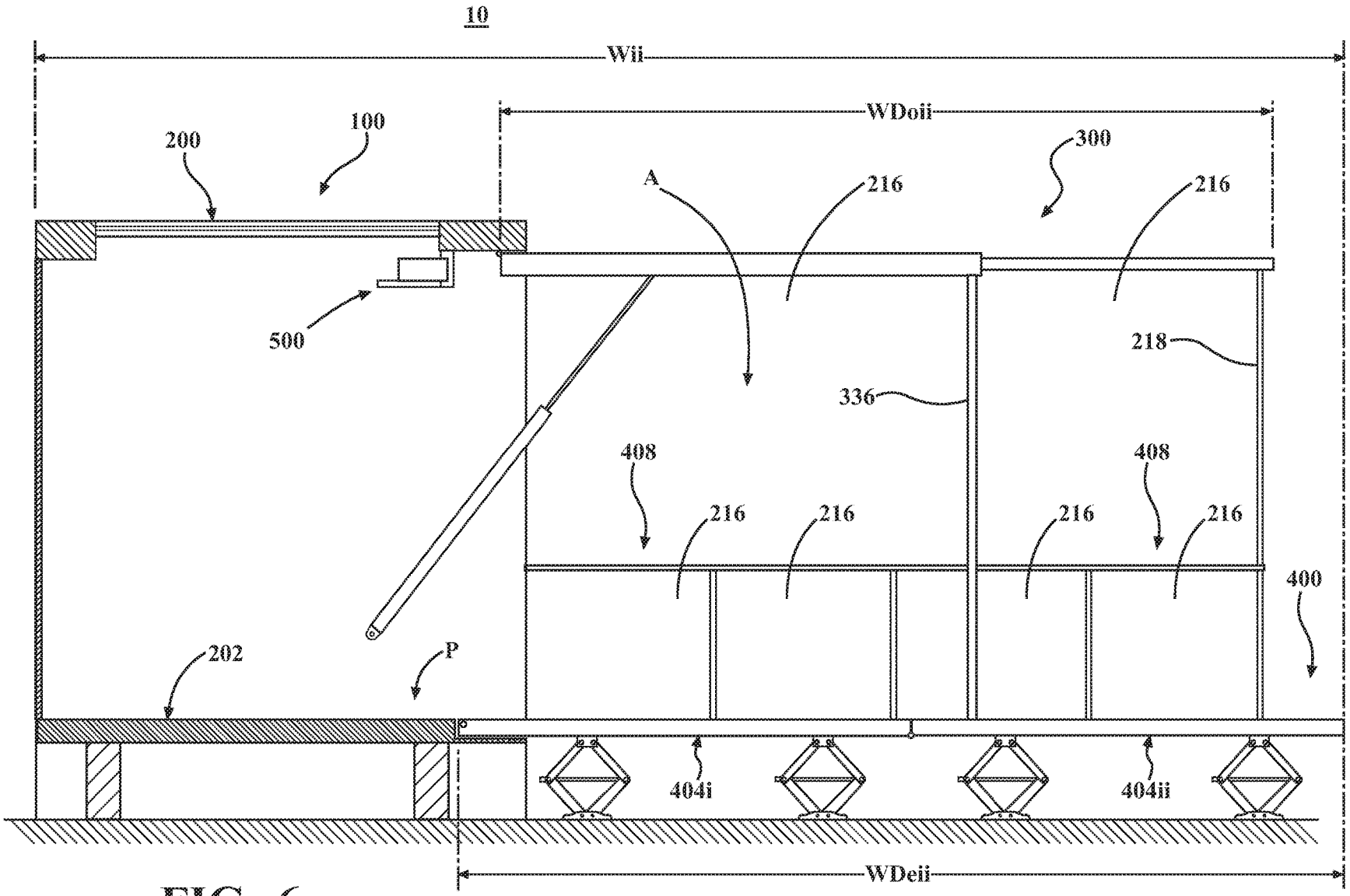
FIG. 6 is an end, cross-sectional view of the portable training studio shown in the use configuration with the door shown in the open position and in an expanded configuration and with the deck shown in the open configuration.

The deck 400 includes a (first) deck panel (section) 404*i* and a (second) deck panel (section) 404*ii* that is movable in relation to the (first) deck panel 404*i*. In the illustrated embodiment, for example, the deck panels 404*i*, 404*ii* are pivotably connected to each other (e.g., via one or more hinge elements 405 (FIG. 5)), which facilitates reconfiguration of the deck 400 between the closed configuration (FIGS. 3A, 4) and the open configuration (FIG. 6). More specifically, the deck panel 404*ii* pivots in relation to the deck panel 404*i* such that the deck 400 is extendable along an axis of movement MDe (FIG. 5) that extends in (generally) parallel relation to a width WDe of the deck 400 and in (generally) orthogonal relation to a length LDe of the deck 400 (and a (longitudinal) axis XDe thereof).

In the closed configuration, the deck 400 defines a (first) width WDei (FIG. 4) that (generally) approximates the height H of the expandable structure 100 (and the width WDoi of the door 300 in the collapsed configuration). In the open configuration, however, the door 300 defines a (second) width WDeii (FIG. 6) that exceeds the height H of the expandable structure 100 and (generally) approximates the width WDoii of the door 300 in the expanded configuration. To reduce spatial requirements, it is envisioned that the deck panel 404*i* may define a chamber 406 (FIG. 2) that is configured to receive the deck panel 404*ii* upon movement of the deck 400 into the closed configuration such that the deck panel 404*ii* nests within the deck panel 404*i*. To enhance the safety features of the studio 10, it is envisioned that one or more safety rails 408 (FIG. 6) may be provided that are configured for removable connection to the deck 400 when the deck 400 is in the open configuration.

As mentioned above, the height H of the studio 10 is limited by various regulations that are imposed on movable vehicles, which also necessarily limits the width WDei of the deck 400 in the closed configuration. The multi-panel construction of the deck 400, like the door 300, however, allows for an increase in the effective training area A (footprint) provided by the studio 10 in the use configuration. For example, upon movement of the deck 400 into the open configuration, the width W of the expandable structure 100 may be extended by (approximately) 14 feet to (approximately) 24 feet, as discussed above. It should be appreciated, however, that the dimensions of the deck panel

404*i* and/or the deck panel 404*ii* may be varied as necessary or desired to further alter the effective training area A provided by the studio 10.

To facilitate reconfiguration of the deck 400 between the closed configuration and the open configuration, in certain embodiments, such as that shown throughout the figures, the deck 400 may include one or more casters (wheels) 410 that are either fixedly or removably connected to a lateral end 412 (FIG. 2) of the deck 400 (e.g., the deck panel 404*ii*). The casters 410 are configured and positioned to contact the ground during deployment (unfolding, opening) of the deck 400 so as to support the deck panel 404*ii* as the deck panel 404*ii* moves laterally outward (e.g., away from the frame 200).

To support the weight of the deck 400, as well as that of any users, it is envisioned that the studio 10 may include one or more footings 414, which may be either fixedly or removably connected to the deck 400. In the illustrated embodiment, for example, the studio 10 include a first plurality of footings 414*i* that are configured as support jacks 416 and a second plurality of footings 414*ii* that are configured as wheel assemblies 418.

The jacks 418 are configured for connection (either fixedly or removably) to an underside (bottom surface) 420 of the deck 400 and are extendable into contact with the ground. The jacks 418 are configured for expansion and collapse to allow for incremental adjustment in the height of the deck 400 and the support provided by the jacks 418. To reduce spatial requirements, it is envisioned that the deck 400 and the jacks 418 may be configured such that the jacks 418 are stowable beneath the deck 400 (e.g., between the deck panels 404*i*, 404*ii*). More specifically, it is envisioned that the jacks 418 may be configured so as to nest between joists 422 of the deck 400.

The wheel assemblies 418 are located adjacent to (front and rear) end regions 424*f*, 424*r* of the deck 400 and may be either fixedly or removably connected thereto. In the illustrated embodiment, the wheel assemblies 418 include an A-frame configuration, which further supports the weight of the deck 400, and are configured such that the deck 400 is (generally) level and continuous with the base 202 with the deck 400 is in the open configuration.

Although generally shown as including a single door 300 and a single deck 400 in the particular embodiment of the studio 10 illustrated throughout the figures, in order to further increase in the effective training area A (footprint) (FIG. 6) provided by the studio 10 in the use configuration, in an alternate embodiment of the studio 10, which is identified by the reference character 10' (FIG. 3B), it is envisioned that the side wall 208 (FIGS. 1, 3A) may be replaced by a (second) door 300*ii* that is positioned opposite to the (first) door 300 and a (second) deck 400*ii* that is positioned opposite to the (first) deck 400. By replacing the side wall 208 with the door 300*ii* and the deck 400*ii*, it is envisioned that the width Wii (FIG. 6) of the expandable structure 10' in the use configuration may lie substantially within the range of (approximately) 40 feet to (approximately) 50 feet. In such embodiments, the door 300*ii* and the deck 400*ii* may be (generally) identical to the door 300 and the deck 400 discussed above, respectively, and may be connected to the frame 200 for operation in the identical manner (e.g., such that the door 300*ii* is pivotably connected to the frame 200 for movement between open and closed positions and such that the deck 400*ii* is pivotably connected to the frame 200 for movement between open and closed configurations).

In additional embodiments of the present disclosure, it is envisioned that the studio 10 may include a variety of supplemental components to improve the structural integrity of the studio 10, user convenience, and the overall user experience. For example, it is envisioned that the studio 10 may include a water station, a collapsible or stowable retail module, one or more restroom facilitates, and the like.

It is also envisioned that the roof 204 may incorporate a plurality of panels 216 (FIG. 3A) including (e.g., formed partially or entirely from) a material that allows light to pass therethrough (e.g., clear or partially clear polycarbonate), which may be either fixedly or removably supported.

To improve use of the studio 10 (e.g., in in inclement weather), it is envisioned that the studio 10 may include one or more removable walls 218 (FIG. 6), which may be configured for removable connection to the safety rails 408, the deck 400, the door 300, or any other suitable structure or component of the studio 10 so as to partially or enclose the training area A. Enclosure of the training area A may be supplemented by additional panels 216, which may be connected to the removable walls 218, the safety rails 408, the deck 400, the door 300, etc.

Persons skilled in the art will understand that the various embodiments of the present disclosure described herein, and shown in the accompanying figures, constitute non-limiting examples, and that additional components and features may be added to any of the embodiments discussed hereinabove without departing from the scope of the present disclosure. Additionally, persons skilled in the art will understand that the elements and features shown or described in connection with one embodiment may be combined with those of another embodiment without departing from the scope of the present disclosure to achieve any desired result and will appreciate further features and advantages of the presently disclosed subject matter based on the description provided. Variations, combinations, and/or modifications to any of the embodiments and/or features of the embodiments described herein that are within the abilities of a person having ordinary skill in the art are also within the scope of the present disclosure, as are alternative embodiments that may result from combining, integrating, and/or omitting features from any of the disclosed embodiments.

While the present disclosure has been described in connection with certain embodiments, it is to be understood that the present disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

Use of the term "optionally" with respect to any element of a claim means that the element may be included or omitted, with both alternatives being within the scope of the claim. Additionally, use of broader terms such as "comprises," "includes," and "having" should be understood to provide support for narrower terms such as "consisting of," "consisting essentially of," and "comprised substantially of." Accordingly, the scope of protection is not limited by the description set out above, but is defined by the claims that follow, and includes all equivalents of the subject matter of the claims.

In the preceding description, reference may be made to the spatial relationship between the various structures illustrated in the accompanying drawings, and to the spatial orientation of the structures. However, as will be recognized by those skilled in the art after a complete reading of this disclosure, the structures described herein may be positioned and oriented in any manner suitable for their intended purpose. Thus, the use of terms such as "above," "below," "upper," "lower," "inner," "outer," "left," "right," "upward," "downward," "inward," "outward," "horizontal," "vertical," etc., should be understood to describe a relative relationship between the structures and/or a spatial orientation of the structures. Those skilled in the art will also recognize that the use of such terms may be provided in the context of the illustrations provided by the corresponding figure(s).

Additionally, terms such as "approximately," "generally," "substantially," and the like should be understood to allow for variations in any numerical range or concept with which they are associated. For example, it is intended that the use of terms such as "approximately" and "generally" should be understood to encompass variations on the order of 25% (e.g., to allow for manufacturing tolerances and/or deviations in design).

Although terms such as "first," "second," etc., may be used herein to describe various operations, elements, components, regions, and/or sections, these operations, elements, components, regions, and/or sections should not be limited by the use of these terms in that these terms are used to distinguish one operation, element, component, region, or section from another. Thus, unless expressly stated otherwise, a first operation, element, component, region, or section could be termed a second operation, element, component, region, or section without departing from the scope of the present disclosure.

Each and every claim is incorporated as further disclosure into the specification and represents embodiments of the present disclosure. Also, the phrases "at least one of A, B, and C" and "A and/or B and/or C" should each be interpreted to include only A, only B, only C, or any combination of A, B, and C.

What is claimed is:

1. A portable training studio configured as a vehicle, the vehicle comprising:

an expandable structure reconfigurable between a transport configuration and a use configuration, the expandable structure comprising:

a frame that defines a gym space to provide a training area;

a first door pivotably connected to the frame such that the first door is movable between an open position and a closed position; and a first deck pivotably connected to the frame such that the first deck is movable between an open configuration and a closed configuration to thereby enlarge the training area defined by the frame, the first deck including a first panel and a second panel pivotally connected to the first panel to allow for extension and collapse of the first deck during movement between the closed configuration and the open configuration, the first panel defining a chamber configured to receive the second panel upon movement of the first deck into the closed configuration such that the second panel nests within the first panel to reduce spatial requirements of the expandable structure.

2. The portable training studio of claim 1, wherein the frame includes:

a roof;

a base supporting the roof; and end walls extending between the roof and the base.

3. The portable training studio of claim 2, wherein the frame further includes a side wall positioned opposite to the first door and extending between the roof and the base.

4. The portable training studio of claim 3, wherein the end walls and the side wall are each fixed in relation to the base.

5. The portable training studio of claim 1, wherein the first deck is pivotably connected to the frame such that the first deck is positioned inwardly of the first door when the expandable structure is in the transport configuration.

6. The portable training studio of claim 1, wherein the first door is reconfigurable between a collapsed configuration and an expanded configuration.

7. The portable training studio of claim 6, wherein the first door includes a first panel and a second panel slidably connected to the first panel such that the second panel is movable in relation to the first panel during reconfiguration of the first door between the collapsed configuration and the expanded configuration.

8. The portable training studio of claim 7, wherein the second panel is telescopically connected to the first panel such that the second panel is movable along an axis extending in generally orthogonal relation to a longitudinal axis of the door.

9. The portable training studio of claim 7, wherein the frame further includes:

a second door positioned opposite to the first door; and a second deck positioned opposite to the first deck.

10. The portable training studio of claim 9, wherein the second door is pivotably connected to the frame such that the second door is movable between an open position and a closed position.

11. The portable training studio of claim 10, wherein the second deck is pivotably connected to the frame such that the second deck is movable between an open configuration and a closed configuration to thereby further enlarge the training area defined by the frame.

12. The portable training studio of claim 11, wherein the second door is generally identical to the first door and the second deck is generally identical to the first deck.

13. A portable training studio configured as a vehicle, the vehicle comprising:

an expandable structure reconfigurable between a transport configuration and a use configuration, the expandable structure including:

a frame that defines a gym space to provide a training area;

a door pivotably connected to the frame such that the door is movable between an open position and a closed position, the door defining a longitudinal axis and including:

a first panel;

a second panel movably connected to the first panel such that the door is reconfigurable between a collapsed configuration and an expanded configuration; and a tensioning mechanism connected to the door and located exclusively on the first panel, the tensioning mechanism extending along the longitudinal axis of the door to inhibit deflection of the door in the expanded configuration, wherein the tensioning mechanism includes a support having a first end fixedly connected to a first end region of the first panel and a second end fixedly connected to a second end region of the first panel, the support applying a force to the door directed outwardly away from a centerline of the door to counteract sagging in the door; and a deck pivotably connected to frame such that the deck is movable between a closed configuration and an open configuration to thereby enlarge the training area defined by the frame, the deck including a first panel and a second panel pivotally connected to the first panel to allow for extension and collapse of the deck during movement between the closed configuration and the open configuration, the first panel of the deck defining a chamber configured to receive the second panel of the deck upon movement of the deck into the closed configuration such that the second panel of the deck nests within the first panel of the deck to reduce spatial requirements of the expandable structure.

14. The portable training studio of claim 13, wherein the expandable structure further includes a drive mechanism connected to the door to move the door between the open position and the closed position.

15. The portable training studio of claim 14, wherein the drive mechanism includes an extender extending between the frame and a first end region of the door.

16. The portable training studio of claim 15, wherein the extender is slidably connected to the door.

17. A method of operating a portable training studio configured as a vehicle, the method comprising:

reconfiguring an expandable structure from a transport configuration to a use configuration to define a gym space providing a training area, wherein reconfiguring the expandable structure includes:

moving a door pivotably connected to a frame of the expandable structure from a closed position to an open position;

moving a deck pivotably connected to the frame from a closed configuration to an open configuration to enlarge the training area provided by the gym space, the deck including a first panel and a second panel pivotally connected to the first panel;

expanding the deck by causing relative pivotal movement between the first panel and the second panel such that the second panel is removed from a chamber defined by the first panel, the chamber being configured to receive the second panel when the deck is in the closed configuration such that the second panel nests within the first panel to reduce spatial requirements of the expandable structure;

moving the door from a collapsed configuration to an expanded configuration; and applying a force to the door in the expanded configuration via a tensioning mechanism such that the force is directed outwardly away from a centerline of the door to counteract sagging in the door, the tensioning mechanism extending along a longitudinal axis of the door and including a support having a first end fixedly connected to a first end region of the door and a second end fixedly connected to a second end region of the door.

18. The method of claim 17, wherein moving the door from the collapsed configuration to the expanded configuration includes telescopically moving a first section of the door in relation to a second section of the door.

19. The portable training studio of claim 13, wherein the support includes a cable.

20. The portable training studio of claim 13, wherein the tensioning mechanism further includes a tensioner connected to the support and configured to vary tension in the support to increase or decrease the force applied to the door by the support.

* * * * *